US005465543A

United States Patent [19]

Seifert

[11] Patent Number: 5,465,543

[45] Date of Patent: Nov. 14, 1995

[54] IMITATION WEATHERBOARD

[75] Inventor: Bernhard U. Seifert, East Kew, Australia

[73] Assignee: Tanner Bond Pty. Ltd., Mitcham, Australia

[21] Appl. No.: 445,582

[22] Filed: May 22, 1995

Related U.S. Application Data

[63] Continuation of Ser. No. 140,163, Dec. 23, 1993, abandoned.

[51] Int. Cl.[6] ..... E04C 1/00

[52] U.S. Cl. ..... 52/309.8; 52/545; 52/529; 52/796.1

[58] Field of Search ..... 52/309.8, 811, 52/529, 530, 545, 547, 523, 524, 811; 428/141, 158

[56] References Cited

U.S. PATENT DOCUMENTS

| | | | |
|---|---|---|---|
| 2,126,676 | 8/1938 | Thomas | 52/284 |
| 3,158,960 | 12/1964 | Newton et al. | 50/200 |
| 3,159,943 | 12/1964 | Sugar et al. | 50/200 |
| 3,214,876 | 11/1965 | Mattes | 52/520 |
| 3,248,835 | 3/1966 | Westlind | 52/404 |
| 3,826,054 | 7/1974 | Culpepper, Jr. | 52/309 |
| 3,998,021 | 12/1976 | Lewis | 52/531 |
| 4,033,802 | 7/1977 | Culpepper, Jr. et al. | 156/71 |
| 4,034,528 | 7/1977 | Sanders et al. | 52/309.4 |
| 4,081,939 | 4/1978 | Culpepper, Jr. et al. | 52/535 |
| 4,154,040 | 5/1979 | Pace | 52/521 |
| 4,320,613 | 3/1982 | Kaufman | 52/521 |
| 4,400,918 | 8/1983 | Lewis | 52/98 |
| 4,506,486 | 3/1985 | Culpepper, Jr. et al. | 52/529 |
| 4,580,383 | 4/1986 | Pittman et al. | 52/524 X |
| 4,586,304 | 5/1986 | Flamand | 52/309.8 |
| 4,598,522 | 7/1986 | Hoofe, III | 52/555 |
| 4,782,638 | 11/1988 | Hovind | 52/547 |
| 4,864,787 | 9/1989 | Bukowski | 52/284 |
| 4,864,788 | 9/1989 | Tippmann | 52/309.8 |
| 4,969,302 | 11/1990 | Coggan et al. | 52/309.8 |

FOREIGN PATENT DOCUMENTS

| | | | |
|---|---|---|---|
| 2015134 | 4/1970 | France | 52/529 |

*Primary Examiner*—Lanna Mai
*Attorney, Agent, or Firm*—Walter C. Farley

[57] ABSTRACT

An imitation weatherboard assembly has two or more weatherboard elements (1) of plastics material which simulate overlapped weatherboard and a preformed backing sheet (11). The backing sheet (11) has a front surface (12) which, in use, abuts the back surface of the weatherboarding elements (1), the front surface of the backing sheet being formed to conform to the rear profile of the imitation weatherboarding elements so that the backing sheet (11) establishes contact with a significant portion of the rear area of the weatherboard elements. A planar edge (8) along the upper edge of an element (1) engages a slot (13) formed in the front of backing sheet (11).

10 Claims, 1 Drawing Sheet

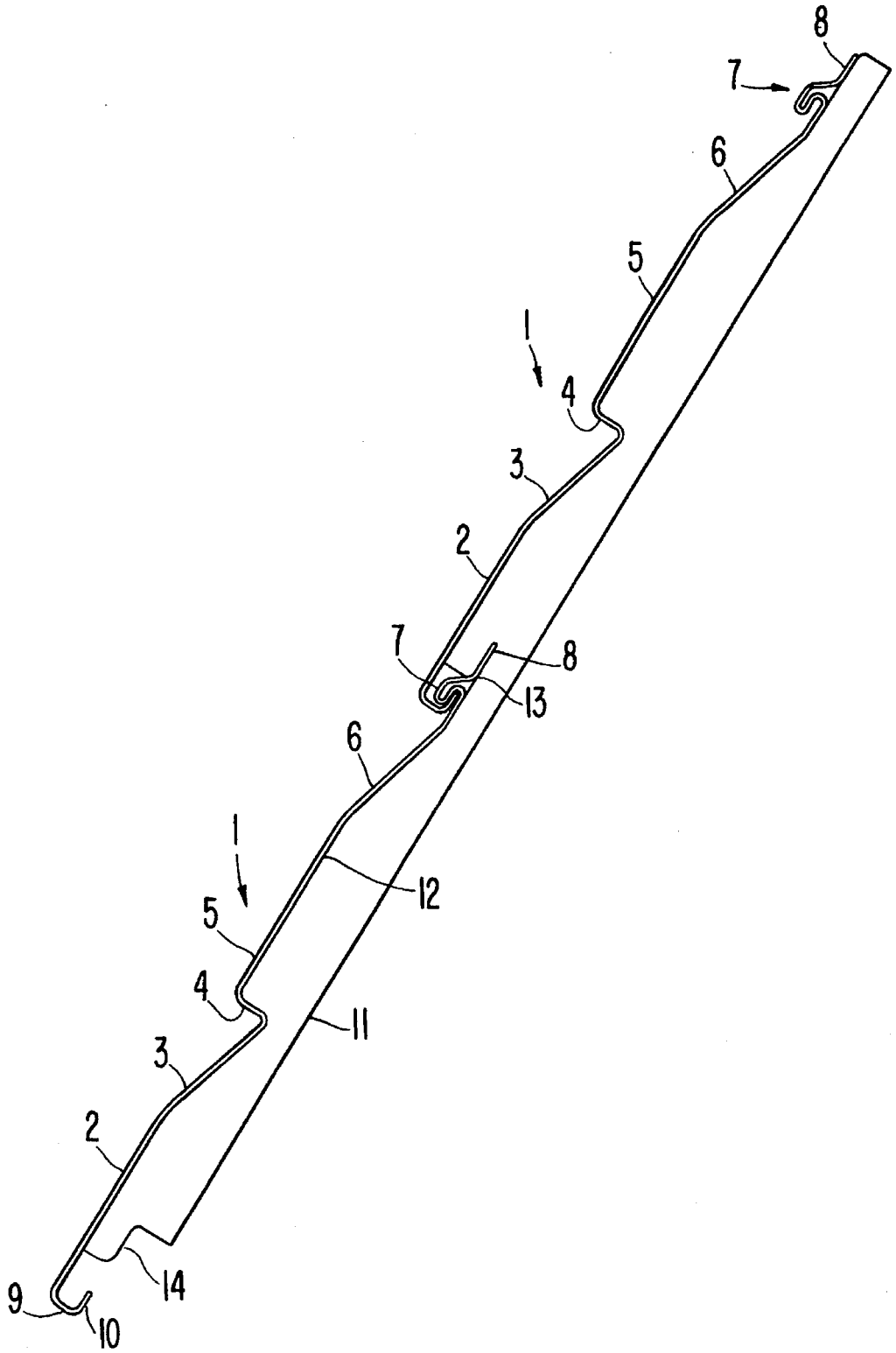
8
7
6
5
1
4
3
2
7
8
13
6
1
12
5
4
11
3
2
14
9
10

IMITATION WEATHERBOARD

CROSS-REFERENCE TO RELATED APPLICATION

This is a continuation of application Ser. No. 08/140,163 filed Dec. 23, 1993, and now abandoned.

FIELD OF THE INVENTION

For many years houses have been clad with weatherboarding which comprises boards of wood mounted, optionally with intermediate battens, on the exterior of a building, with one edge of each board overlapping the adjacent edge of the adjacent board. This is sometimes known as "ship-lap".

Wood weatherboarding possesses the disadvantage that the wood needs to be maintained regularly, and even if it is maintained the wood will eventually perish, meaning that the weatherboarding will have to be replaced. It has therefore been proposed to produce imitation weatherboarding which does not present these difficulties. Such imitation weatherboarding may be formed from plastics or aluminium extrusions, which present the exterior appearance of a plurality of boards which are ship-lapped together, the extrusions themselves being able to be joined together adjacent one another to enable the extrusions to be mounted on a large area of a building to simulate weatherboarding on the building. The extrusions may be secured in position by means of nails or screws which pass through the extrusions either directly into the building or into battens mounted on the building.

It is conventional to provide a foam insulation sheet between the extrusions and the building to provide some degree of thermal insulation.

One problem that has been encountered with existing imitation weatherboarding of the type described above is that when it is raining, the rain falls on the extrusions, and can produce a "drumming" sound. If a significant part of the house is covered with the imitation weatherboarding this can be a significant disadvantage.

SUMMARY OF THE INVENTION

An object of the present invention is to provide an improved weatherboarding assembly.

According to this invention there is provided an imitation weatherboarding arrangement, the arrangement comprising at least one imitation weatherboard element defining at least one "board" and at least one pre-formed backing sheet, the backing sheet having an exposed surface which is configured to conform to the rear profile of the said element or elements when mounted in position on the backing sheet so that the backing sheet establishes contact with a significant proportion of the rear area of the said element or elements.

Preferably the arrangement includes a plurality of said elements.

Conveniently each element defines a plurality of boards which overlap.

Advantageously a plurality of said elements are associated with a backing sheet. Thus each backing sheet may for example be twice as large as one of said elements.

Preferably the backing sheet is made of foamed plastics.

Conveniently the backing sheet is expanded polystyrene.

Preferably the or each element is an extrusion of a plastics material.

BRIEF DESCRIPTION OF THE INVENTION

In order that the invention may be more readily understood, and so that further features thereof may be appreciated, the invention will now be described, by way of example, with reference to the accompanying drawing which is a cross-sectional view of artificial weatherboarding in accordance with the invention.

DESCRIPTION OF THE PREFERRED EMBODIMENT

Artificial weatherboarding in accordance with the invention is formed from a plurality of extrusions of plastic or aluminium, and in the present example is formed from extrusions of a vinyl material. Two such extrusions 1 are shown in the drawing, and are inter-engaged. Each extrusion comprises a first planar portion 2 representing a front face of a plank and an inclined portion 3 adjacent thereto representing where a first plank is ship-lapped under an adjacent plank. Each extrusion presents a perpendicularly extending portion 4 representing the lower edge of a second plank and a further planar portion 5 aligned with the first horizontal portion 2 representing the front face of the second plank. A further inclined portion 6 represents where the second plank is ship-lapped under a further plank.

The lower end of the inclined portion 6 is provided with a reflexed portion 7 which forms a hook-like engagement, the reflexed portion terminating with a short planar portion 8. At the opposed end of the extrusion, the surface 2 terminates with a downwardly extending portion 9 which effectively corresponds to the perpendicular portion 4 and a rearwardly returned terminal portion 10. As can be seen from the region 11 of FIG. 1 the downwardly extending portion 9 and the inwardly returned portion 10 of one extrusion may be engaged with the hook-like portion 7 of an adjacent extrusion, to produce a relatively large area of imitation weatherboarding. Clearly a large number of extrusions may be joined together in this way.

In the present invention the extrusions, as described above, are used in combination with a backing sheet. The backing sheet may be formed of a foamed plastics material, such as foamed polystyrene. Preferably the foamed plastics material provides significant insulating properties. As can be seen, the backing material has a profiled upper surface 12 which is designed to touch the extrusions 1 underneath the surfaces 2, 3, 4, 5 and 6 as described above. Thus, these surfaces are prevented from "drumming" when it rains.

It is to be appreciated that in providing a building with weatherboarding as described above, initially the backing sheet is secured in position, optionally with the use of intermediate battens, by driving nails or screws through the backing sheet. Since the backing sheet is made of polystyrene this is not a difficult task. Subsequently, the lower-most extrusion 1 is mounted in position on the backing sheet. The planar portion 8 of the first extrusion 1 is inserted into a slot 13 which is provided for that purpose in the backing sheet. The second extrusion is then mounted in position, with the returned portion 10 of the second extrusion engaging the hook-like portion of the first extrusion. A second backing sheet may then be mounted in position. It can be seen that the backing sheet 11 is provided with a recessed portion 14 which can be engaged over the upper end of an adjacent backing sheet, trapping the planar portion 8 of the upper extrusion on that backing sheet.

While the invention has been described with reference to one embodiment it is to be appreciated that many modifications of design may be effected without departing from the scope of the invention as defined in the following claims.

I claim:

1. An imitation weatherboarding assembly comprising the combination of a preformed backing sheet and a plurality of imitation weatherboarding elements, said backing sheet having a front surface shaped to conform to a rear surface of at least two said elements when said elements are mounted against said backing sheet and having a significant portion of said rear surface of said elements in contact with a said front surface of said backing sheet, said front surface including indentations simulating lower edges of overlapped weatherboards, said backing sheet having means in said front surface thereof defining an edge-receiving recess extending inwardly from one of said indentations, each of said at least two elements having an upper edge with a substantially planar edge portion and an adjacent reflexed portion forming a hook, and a lower edge with a returned portion shaped and dimensioned to engage said hook on said upper edge of an adjacent element, said planar edge portion of at least one of said elements engaging said edge-receiving recess in said backing sheet.

2. An assembly according to claim 1 wherein said backing sheet is dimensioned to be assembled with two said elements and is formed with one said edge-receiving recess.

3. An assembly according to claim 1 wherein said edge receiving recess comprises a slot in said front surface of said backing sheet for receiving said planar edge portion.

4. An assembly according to claim 1 and further comprising means defining a second recess along a lower edge of said backing sheet for receiving an upper edge of an adjacent backing sheet.

5. An assembly according to claim 1 wherein said reflexed portion comprises a first, reversely-turned edge section spaced from a front surface of said element to define said hook and a second reversely-turned portion which terminates at said planar edge portion.

6. An assembly according to claim 5 wherein said hook closely engages said returned lower edge portion of an adjacent element with said second reversely-turned portion of said reflexed portion received within a channel formed by said returned lower edge portion.

7. An assembly according to claim 1 wherein each said weatherboard element is shaped to present the appearance of at least two overlapping weatherboards.

8. An assembly according to claim 1 wherein said elements are formed of sheet synthetic plastics material and said backing sheet is foamed polystyrene.

9. An imitation weatherboard assembly comprising the combination of:

a preformed backing sheet and a plurality of imitation weatherboard elements, each of said elements having an upper edge with a substantially planar edge portion and a reflexed portion forming a hook adjacent said planar edge portion;

a lower edge with a returned portion shaped and dimensioned to engage said hook on an upper edge of an adjacent element, the engaged elements forming a representation of overlapping weatherboards;

said backing sheet having a front surface shaped to conform to rear surfaces of at least two said elements when said at least two elements are inter-engaged and said elements ate mounted against said front surface of said backing sheet, said elements having a significant portion of said rear surface in contact with said shaped front surface of said backing sheet, said front surface including surfaces shaped to conform generally to the shape of the representation of overlapping weatherboards in a region adjacent said engaged edges of said engaged elements including indentations extending inwardly from said front surface of said backing sheet, and said backing sheet including means defining a longitudinal slot in at least one of said indentations of said backing sheet at said region extending generally in a plane of said assembly, said planar edge portion of one of said engaged elements engaging within said slot.

10. An imitation weatherboard assembly comprising the combination of a preformed backing sheet attachable to a building structure;

a plurality of imitation weatherboard elements adapted to be assembled in groups of at least two with said backing sheet;

said backing sheet having a front surface shaped to conform to a rear surface of a group of at least two said elements when said elements are mounted against said backing sheet and to have a significant portion of said rear surface of said elements in contact with a said front surface of said backing sheet, said backing sheet having indentations simulating lower edges of overlapped weatherboards and means in at least one of said indentations defining an edge-receiving recess extending inwardly therefrom, each of said at least two elements having a first edge with an integrally formed substantially planar edge portion and an adjacent reflexed portion forming a hook, said edge with said planar edge portion being an upper edge when assembled and with said hook opening downwardly, and a second edge with a returned portion integrally formed on said element and shaped and dimensioned to engage said hook on said upper edge of an adjacent element, said second edge being a lower edge when assembled and said returned portion opening upwardly, said planar edge portion of at least one of said elements engaging said edge-receiving recess in said backing sheet.

* * * * *